US007488156B2

(12) United States Patent
Liang

(10) Patent No.: US 7,488,156 B2
(45) Date of Patent: Feb. 10, 2009

(54) TURBINE AIRFOIL WITH FLOATING WALL MECHANISM AND MULTI-METERING DIFFUSION TECHNIQUE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 429 days.

(21) Appl. No.: 11/447,730

(22) Filed: Jun. 6, 2006

(65) Prior Publication Data

US 2007/0280832 A1 Dec. 6, 2007

(51) Int. Cl.
*F01D 5/18* (2006.01)

(52) U.S. Cl. ..... 416/97 R; 416/96 R

(58) Field of Classification Search ..... 415/115; 416/97 R, 97 A, 96 R
See application file for complete search history.

(56) References Cited

U.S. PATENT DOCUMENTS 3,619,076 A 11/1971 Kydd
3,620,643 A * 11/1971 Jones ..... 416/90 R
4,142,824 A 3/1979 Andersen
4,376,004 A * 3/1983 Bratton et al. ..... 156/89.27
5,392,515 A 2/1995 Auxier et al.
5,405,242 A 4/1995 Auxier et al.
5,516,260 A 5/1996 Damlis et al.
5,536,143 A 7/1996 Jacala et al.
5,702,232 A * 12/1997 Moore ..... 416/95
5,762,471 A 6/1998 Cunha
6,019,579 A 2/2000 Fukuno et al.
6,183,192 B1 2/2001 Tressler et al.
6,283,708 B1 9/2001 Zelesky
6,398,486 B1 6/2002 Storey et al.
6,435,814 B1 8/2002 Yu et al.
6,468,031 B1 10/2002 Yu et al.
6,517,312 B1 2/2003 Jones et al.
6,561,757 B2 5/2003 Burdgick et al.

* cited by examiner

*Primary Examiner*—Edward Look
*Assistant Examiner*—Dwayne J White

(57) ABSTRACT

A turbine airfoil usable in a turbine engine and having at least one cooling system. The turbine airfoil may include an interlayer coupled to an outer surface of the outer wall of the airfoil, wherein the interlayer may be formed from a porous material that allows cooling fluids to pass through the interlayer. The floating wall may be coupled to an outer surface of the interlayer, wherein the floating wall may be formed from a plurality of floating wall segments positioned in close proximity to each other but with a film cooling slot positioned between the adjacent wall segments to enable cooling fluids to be exhausted from the elongated hollow airfoil. The cooling system may include an outer wall diffusion chamber positioned in the outer wall and an interlayer diffusion chamber. One or more metering holes may be in communication with the outer wall and interlayer diffusion chambers.

20 Claims, 4 Drawing Sheets

TURBINE AIRFOIL WITH FLOATING WALL MECHANISM AND MULTI-METERING DIFFUSION TECHNIQUE

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine airfoil having an internal cooling system for removing heat from the turbine airfoil. The turbine airfoil may be formed from a generally elongated hollow airfoil having a leading edge, a trailing edge, a pressure side, a suction side, a first end adapted to be coupled to a hook attachment, a second end opposite the first end and adapted to be coupled to an inner endwall, and a cooling system in which a portion of the cooling system is positioned in the outer wall. The airfoil may include an interlayer attached to an outer surface of the outer wall of the airfoil and may include a floating wall attached to an outer surface of the interlayer. The floating wall may be formed from a plurality of segments with any appropriate shape. The segments may be positioned in close proximity to each other with a film cooling slot positioned between the segments. A thermal barrier coating may be applied to an outer surface of the floating wall.

The cooling system may be formed from one or more outer wall diffusion chambers and one or more interlayer diffusion chambers positioned in an interlayer of the turbine airfoil. The outer wall diffusion chambers may be positioned in the outer wall and in fluid communication with one or more central cooling fluid supply chambers through one or more first metering holes positioned in the outer wall. The interlayer diffusion chambers may be in fluid communication with the outer wall diffusion layers through one or more second metering holes. The interlayer may be formed from materials capable of withstanding the hot conditions found within turbine engines while enabling cooling fluids to pass through the interlayer. In at least one embodiment, the interlayer may be formed from materials such as, but not limited to, a metallic felt metal pad, such as a low porosity and low modulus metallic felt metal pad, a porous fiber metal pad and other appropriate materials. The outerwall diffusion chambers may be positioned in rows that extend generally spanwise. The outerwall diffusion chambers may be aligned in the spanwise direction, or in another embodiment, may be offset in the spanwise direction.

During operation, the cooling fluids may flow from a cooling fluid supply source (not shown) through the endwall at the OD of the turbine airfoil. The cooling fluids may flow into the central cooling fluid supply chambers, including the forward and aft central cooling fluid supply chambers. The cooling fluids may flow into the first metering holes. The velocity and rate of fluid flow into the first metering holes may be controlled by the cross-sectional area of the first metering holes. The cooling fluids may then diffuse into the outer wall diffusion chambers. The velocity of the cooling fluids may be reduced due to the larger cross-sectional area in the outer wall diffusion chambers. The cooling fluids may then be further metered by flowing through the second metering holes and into the interlayer diffusion chambers. In the interlayer diffusion chambers, the cooling fluids may impinge on a backside surface of the floating wall. This cooling fluids flow pattern allows the cooling air to uniformly disperse into the interlayer, to uniformly receive heat from the interlayer, and to control the amount of cooling fluids discharged into the film cooling slots. The spent cooling air may be discharged from the airfoil through the film cooling slots positioned between adjacent segments of the floating wall. This cooling mechanism may be repeated throughout the outer walls in the pressure and suction sides. Other cooling fluids may be expelled out of the central cooling fluid supply chambers and into the leading edge impingement chamber and the trailing edge impingement chamber.

An advantage of this invention is that each individual cooling circuit formed from the outer wall diffusion chambers and interlayer diffusion chambers may be independently designed based on local heat load and aerodynamic pressure loading conditions, thereby eliminating localized hot spots.

Another advantage of this invention is that the first and second metering holes are positioned in series and provide multiple layers of metering control of the cooling fluids.

Yet another advantage of this invention is that the second diffusion chamber in the interlayer causes the cooling fluids to impinge on the backside surface of the floating wall and evenly disperse the cooling fluids throughout the interlayer to the film cooling slots in the floating wall. Such a design induces near wall impingement cooling at a much closer distance to the hot gas surface than traditional backside impingement cooling.

Another advantage of this invention is that the interlayer material reduces the velocity of the cooling fluids, thereby minimizing the velocity of the cooling fluids discharge through the film cooling slots and preventing turbulent disruption of the film cooling layer.

Still another advantage of this invention is that the interlayer causes a buildup of cooling fluids forming a sub-boundary cooling layer proximate to the floating wall, which results in better film cooling coverage with a very high cooling effectiveness and uniform floating wall temperatures for the entire airfoil.

Another advantage of this invention is that the outer wall may move generally unrestrained relative to the airfoil outer wall thus enhancing the durability of the thermal barrier coating.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
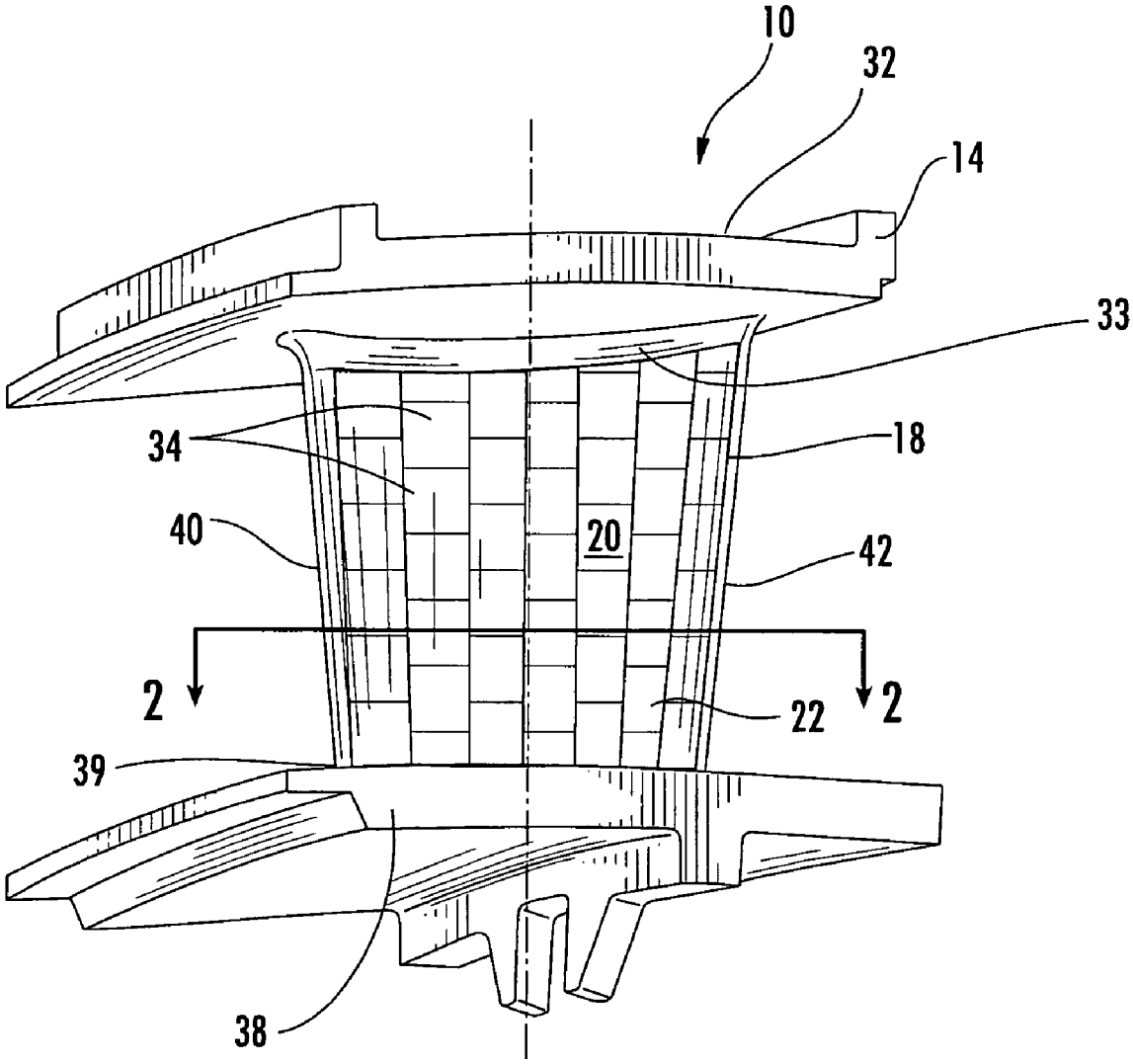
FIG. 1 is a perspective view of a turbine airfoil having features according to the instant invention.

As shown in FIGS. 1-4, this invention is directed to a turbine airfoil 10 having a cooling system 12 in inner aspects of the turbine airfoil 10 for use in turbine engines. The cooling system 12 may be used in any turbine vane or turbine blade. While the description below focuses on a cooling system 12 in a turbine vane 10, the cooling system 12 may also be adapted to be used in a turbine blade. The cooling system 12 may be configured such that adequate cooling occurs within an outer wall 14 of the turbine vane 10 by including one or more cavities 16 in the outer wall 14 and configuring each cavity 16 based on local external heat loads and airfoil gas side pressure distribution in both chordwise and spanwise directions. The chordwise direction is defined as extending between a leading edge 40 and a trailing edge 42 of the airfoil 10. The spanwise direction is defined as extending between an endwall 32 at a first end 33 and an inner endwall 38 at a second end 39.

As shown in FIG. 1, the turbine vane 10 may be formed from a generally elongated hollow airfoil 18 having an outer surface 20 adapted for use, for example, in an axial flow turbine engine. The outer surface 20 may have a generally concave shaped portion forming pressure side 22 and a generally convex shaped portion forming suction side 24. The turbine vane 10 may also include an outer endwall 32 adapted to be coupled to a hook attachment at a first end 33 and may include a second end 39 coupled to an inner endwall 38. The airfoil 22 may also include a leading edge 40 and a trailing edge 42.

Figure 2:
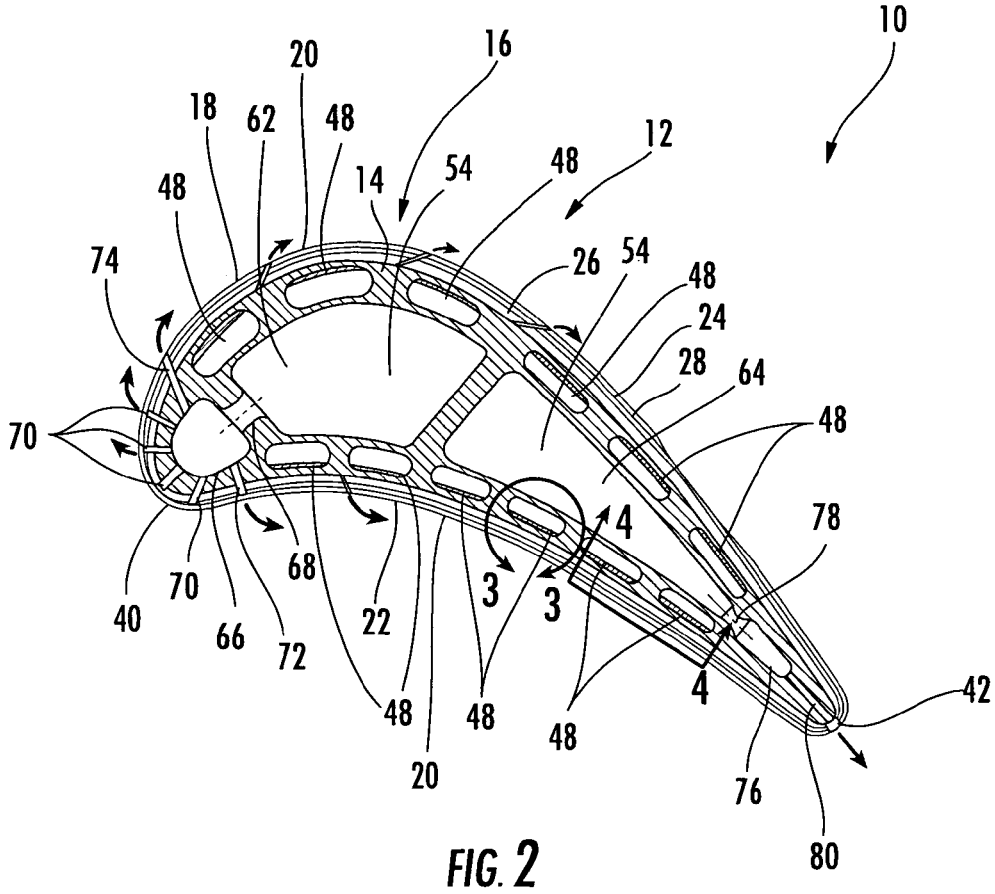
FIG. 2 is a cross-sectional view of the turbine airfoil shown in FIG. 1 taken along section line 2-2.
Figure 3:
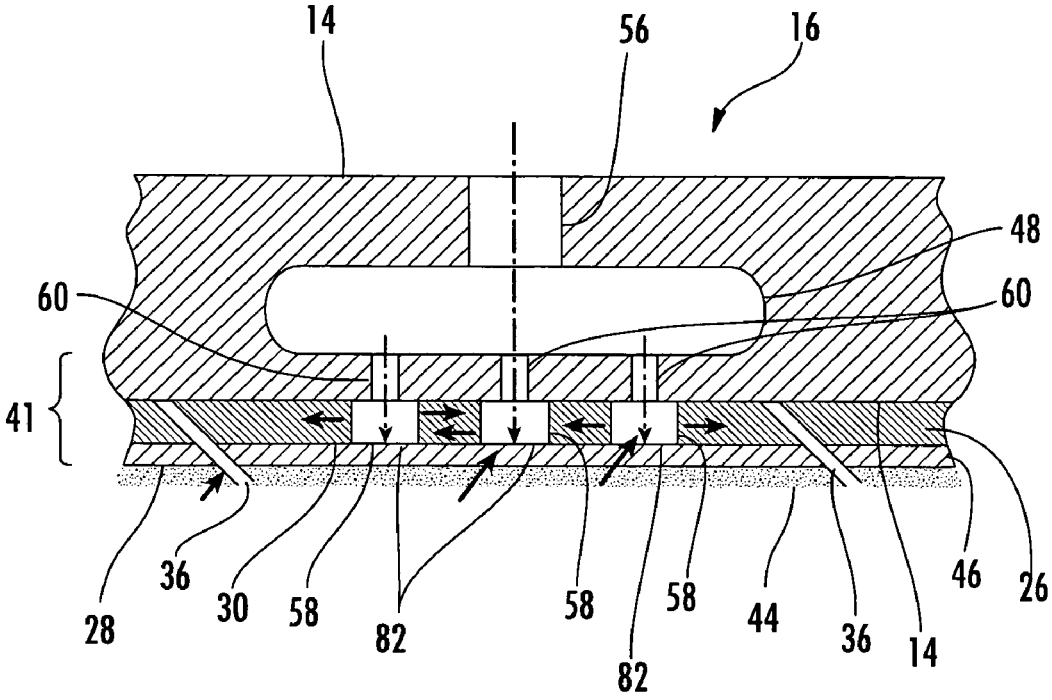
FIG. 3 is a partial cross-sectional view of a cooling system in the turbine airfoil shown in FIG. 2 taken along section line 3-3.

As shown in FIGS. 2 and 3, an interlayer 26 may be coupled to the outer surface 20 of the elongated hollow airfoil 18. The interlayer 26 may be formed from any material capable of withstanding the high temperature environment found in turbine engines such as, but not limited to, a metallic felt metal pad, such as a low porosity and low modulus metallic felt metal pad, a porous fiber metal pad and other appropriate materials. The interlayer 26 may be bonded to the airfoil 18 by brazing or use of transient liquid phase (TLP) processes. The interlayer 26 may operate as a strain isolator by compensating for the mismatch in thermal expansion between the interlayer 26 and the floating wall 28. The interlayer 26 also enables a floating wall 28 attached to the interlayer 26 to grow as a result of thermal expansion yet remain in a stress free configuration.

The elongated hollow airfoil 18 may also include the floating wall 28 attached to an outer surface 30 of the interlayer 26. The floating wall 28 may be formed from any appropriate material capable of withstanding the high temperature environment found in turbine engines. A thermal barrier coating (TBC) 44 may be applied to an outer surface 46 of the floating wall 28 to increase the ability of the airfoil 18 to withstand the hostile environment of the turbine engine. The floating wall 28 may be formed from a plurality of segments 34 positioned in close proximity to each other. The segments 34 may be aligned with components of the internal cooling system 12 as discussed in detail below. The segments 34 may also be spaced apart from each other to create film cooling slots 36 usable with the cooling system 12. The segments 34 may have any configuration and may be formed with a laser engraving technique for cutting the thermal barrier coating 44 and the floating wall 28 to form individual segments 34. The individual segments 34 may be configured to have any shape necessary to reduce thermally induced stress and improve the cyclic durability of the thermal barrier coating 44.

Figure 4:
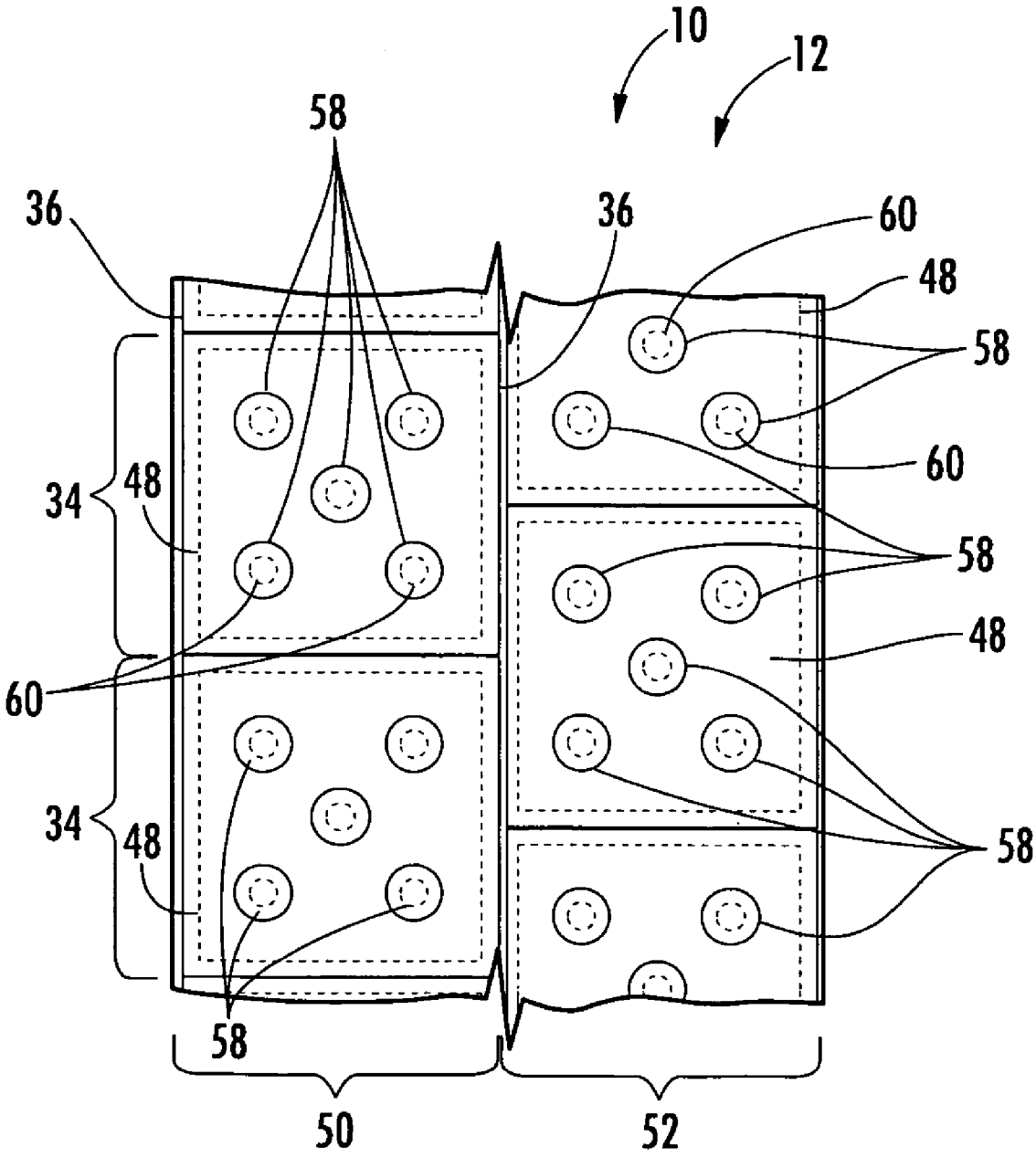
FIG. 4 is a partial cross-sectional view of the turbine airfoil taken along section line 4-4 in FIG. 2.

As shown in FIGS. 2 and 3, the cooling system 12 may be formed from one or more outer wall diffusion chambers 48 positioned in the outer wall 14 of the elongated hollow airfoil 18. In at least one embodiment, the cooling system 12 may include a plurality of outer wall diffusion chambers 48. The plurality of outer wall diffusion chambers 48 may be positioned adjacent to each other. The outer wall diffusion chambers 48 may be positioned in the outer wall 14 of the pressure side 22 or the outer wall 14 of the suction side 24, or both, as shown in FIG. 2. As shown in FIG. 4, the outer wall diffusion chambers 48 may be positioned into rows 50, 52 that extend generally spanwise. The outer wall diffusion chambers 48 of the row 50 may be offset generally spanwise relative to the row 52. This pattern may be repeated through a portion of or all of the elongated hollow airfoil 18. In one embodiment, as shown in FIG. 2, there may be six rows of outer wall diffusion chambers 48 in the outer wall 14 of the pressure side 22 and six rows of outer wall diffusion chambers 48 in the outer wall 14 of the suction side 24. Other embodiments may have other numbers of rows of outer wall diffusion chambers 48. The rows 50, 52 of outer wall diffusion chambers 48 may extend from the first end 33 to the second end 39 of the airfoil 18. In other embodiments, the rows 50, 52 may have shorter lengths. The outer wall diffusion chambers 48 may be in fluid communication with one or more central cooling fluid supply chambers 54 through one or more first metering holes 56. The first metering holes 56 may be sized appropriately based on local heat loads.

The outer wall diffusion chambers 48 may be in fluid communication with area outside of the airfoil 10 through one or more cooling channels 41. In at least one embodiment, the cooling channels 41 may be formed from one or more interlayer diffusion chambers 58 in the interlayer 26, as shown in FIG. 3. The interlayer diffusion chambers 58 may be in fluid communication with the outer wall diffusion chambers 48 through one or more second metering holes 60. In at least one embodiment, as shown in FIGS. 3 and 4, a plurality of second metering holes 60 may be in fluid communication with a single interlayer diffusion chamber 58. In at least one embodiment, five second metering holes 60 may extend from a single interlayer diffusion chamber 58 and may be configured in a general X pattern, as shown in FIG. 4. The five second metering holes 60 may be in fluid communication with five interlayer diffusion chambers 58 forming a matching X pattern. This pattern may be repeated for each outer wall diffusion chamber 58. Alternatively, each outer wall diffusion chambers 48 may have a different configuration. The configuration of second metering holes 60 and interlayer diffusion chambers 58 are not limited to this configuration, but may have other configurations as well.

The sizes of the first metering holes 56, the outer wall diffusion chambers 48, the second metering holes 60, and the interlayer diffusion chambers 58 may be sized to account for localized heat loads. However, for example, in at least one embodiment as shown in FIG. 4, the cross-sectional area of first metering hole 56 may be less than a cross-sectional area of the outer wall diffusion chamber 48. The interlayer diffusion chambers 58 may have a cross-sectional area that is less than the outer wall diffusion chamber 48 and less than the cross-sectional area of the first metering hole 56. The second metering holes 60 may have cross-sectional areas less than the cross-sectional areas of the interlayer diffusion chambers 58. In one embodiment, the first and second metering holes 56, 60 and the interlayer diffusion chambers 58 may be generally cylindrical.

The central cooling fluid supply chambers 54 may be formed from any appropriate configuration for cooling internal aspects of the airfoil 18. In at least one embodiment, as shown in FIG. 2, the central cooling fluid supply chamber 54 may be formed from a forward central cooling fluid supply chamber 62 and an aft central cooling fluid supply chamber 64. In other embodiments, the central cooling fluid supply chamber 54 may be formed from a greater or smaller number of central cooling fluid supply chambers 54.

The central cooling fluid supply chambers 54 may exhaust cooling fluids through numerous channels. As shown in FIG. 2, the central cooling fluid supply chamber 54, and specifically, the forward central cooling fluid supply chamber 62, may be in communication with a leading edge impingement chamber 66 through one or more impingement orifices 68. The leading edge impingement chamber 66 may include a plurality of film cooling holes 70 extending through the outer wall 14 forming a showerhead. A pressure side film cooling hole 72 and a suction side film cooling hole 74 may be positioned in the outer wall 14 as well and may be in fluid communication with the leading edge impingement chamber 66. The leading edge impingement chamber 66 may extend from the first end 33 to the second end 39 of the elongated hollow airfoil 18 or may have a shorter length.

As shown in FIG. 2, the central cooling fluid supply chamber 54, and specifically, the aft central cooling fluid supply chamber 64, may be in communication with a trailing edge impingement chamber 76 through one or more impingement orifices 78. The trailing edge impingement chamber 76 may include a plurality of trailing edge exhaust orifices 80 extending through the outer wall 14 of the trailing edge 42. The trailing edge impingement chamber 76 may extend from the first end 33 to the second end 39 of the elongated hollow airfoil 18 or may have a shorter length.

During operation, the cooling fluids may flow from a cooling fluid supply source (not shown) through the endwall 32 at the OD of the turbine airfoil 10. The cooling fluids may flow into the central cooling fluid supply chambers 54, including the forward and aft central cooling fluid supply chambers 62, 64. The cooling fluids may flow into the first metering holes 56. The velocity and rate of fluid flow into the first metering holes 56 may be controlled by the cross-sectional area of the first metering holes 56. The cooling fluids may then diffuse into the outer wall diffusion chambers 48. The velocity of the cooling fluids may be reduced due to the larger cross-sectional area in the outer wall diffusion chambers 48. The cooling fluids may then be further metered by flowing through the second metering holes 60 and into the interlayer diffusion chambers 58. In the interlayer diffusion chambers 58, the cooling fluids may impinge on a backside surface 82 of the floating wall 28. This cooling fluids flow pattern allows the cooling air to uniformly disperse into the interlayer, to uniformly receive heat from the interlayer 26, and to control the amount of cooling fluids discharged into the film cooling slots 36. The spent cooling air may be discharged from the airfoil 18 through the film cooling slots 36 positioned between adjacent segments 34 of the floating wall 28. The discharged cooling fluids form a boundary layer proximate to the outer surface of the floating wall. This cooling mechanism may be repeated throughout the outer walls 14 in the pressure and suction sides 22, 24.

The cooling fluids may be expelled out of the central cooling fluid supply chambers 54 and into the leading edge impingement chamber 66 and the trailing edge impingement chamber 76. In particular, cooling fluids may pass from the forward central cooling fluid supply chamber 62 and into the leading edge impingement chamber 66 through impingement orifices 68. The cooling fluids may be exhausted from the leading edge impingement chamber 66 through the plurality of film cooling holes 70 extending through the outer wall 14 forming a showerhead. The cooling fluids may also pass from the aft central cooling fluid supply chamber 64 and into the trailing edge impingement chamber 76 through one or more impingement orifices 78. The cooling fluids may be exhausted from the trailing edge impingement chamber 76 through trailing edge exhaust orifices 80 extending through the outer wall 14 of the trailing edge 42.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, and a suction side;

an interlayer coupled to an outer surface of the outer wall of the generally elongated airfoil, wherein the interlayer is formed from a material such that cooling fluids may pass through the interlayer;

a floating wall coupled to an outer surface of the interlayer;

a cooling system comprising:

at least one central cooling fluid supply chamber;

at least one outer wall diffusion chamber positioned in the outer wall of the generally elongated airfoil and in fluid communication with the at least one central cooling fluid supply chamber through at least one first metering hole in the outer wall extending between the at least one outer wall diffusion chamber and the at least one central cooling fluid supply chamber;

at least one cooling channel extending between the at least one outer wall diffusion chamber and the interlayer; and wherein the floating wall comprises at least one film cooling hole in the floating wall for enabling cooling fluids to be exhausted from the cooling system.

2. The turbine airfoil of claim 1, further comprising at least one interlayer diffusion chamber positioned in the interlayer and in communication with the at least one cooling channel extending between the at least one outer wall diffusion chamber and the interlayer.

3. The turbine airfoil of claim 2, wherein the at least one cooling channel extending between the at least one outer wall diffusion chamber and the interlayer comprises at least one second metering hole.

4. The turbine airfoil of claim 3, wherein the at least one interlayer diffusion chamber comprises a plurality of interlayer diffusion chambers that are coupled to a single outer wall diffusion chamber via second metering holes.

5. The turbine airfoil of claim 4, wherein the at least one outer wall diffusion chamber positioned in the outer wall of the generally elongated airfoil comprises a plurality of outer wall diffusion chambers.

6. The turbine airfoil of claim 5, wherein the plurality of outer wall diffusion chambers are positioned in rows extending generally in a chordwise direction.

7. The turbine airfoil of claim 6, wherein the rows of outer wall diffusion chambers are positioned in a repeating pattern in which outer wall diffusion chambers in a row of outer wall diffusion chambers are offset in a chordwise direction from an adjacent row of outer wall diffusion chambers.

8. The turbine airfoil of claim 1, wherein the at least one outer wall diffusion chamber is positioned in the outer wall on the pressure side of the elongated hollow airfoil.

9. The turbine airfoil of claim 8, wherein the at least one outer wall diffusion chamber is positioned in the outer wall on the suction side of the elongated hollow airfoil.

10. The turbine airfoil of claim 1, wherein the at least one outer wall diffusion chamber is positioned in the outer wall on the suction side of the elongated hollow airfoil.

11. The turbine airfoil of claim 1, wherein the at least one film cooling hole comprises a film cooling slot extending between adjacent segments of the floating wall.

12. The turbine airfoil of claim 1, further comprising a leading edge impingement chamber extending generally spanwise in the generally elongated hollow airfoil proximate to the leading edge, wherein the leading edge impingement chamber is in fluid communication with the at least one central cooling fluid supply chamber and includes a plurality of film cooling holes in communication with the leading edge impingement chamber and positioned in the outer wall to create a showerhead.

13. The turbine airfoil of claim 1, further comprising a trailing edge impingement chamber extending generally spanwise in the generally elongated hollow airfoil proximate to the trailing edge, wherein the trailing edge impingement chamber is in fluid communication with the at least one central cooling fluid supply chamber and includes a plurality of trailing edge exhaust orifices in communication with the trailing edge impingement chamber and positioned in the outer wall.

14. The turbine airfoil of claim 1, wherein the interlayer is formed from a material selected from the group consisting of a metallic felt metal pad and a porous fiber metal pad.

15. The turbine airfoil of claim 1, further comprising a thermal barrier coating applied to an outer surface of the floating wall.

16. A turbine airfoil, comprising:

a generally elongated hollow airfoil formed from an outer wall, and having a leading edge, a trailing edge, a pressure side, and a suction side;

an interlayer coupled to an outer surface of the outer wall of the generally elongated airfoil, wherein the interlayer is formed from a porous material that allows cooling fluids to pass through the interlayer;

a floating wall coupled to an outer surface of the interlayer, wherein the floating wall is formed from a plurality of floating wall segments positioned in close proximity to each other but with a film cooling slot positioned between the adjacent wall segments to enable cooling fluids to be exhausted from the elongated hollow airfoil;

a cooling system comprising:

at least one central cooling fluid supply chamber;

at least one outer wall diffusion chamber positioned in the outer wall of the generally elongated airfoil and in fluid communication with the at least one central cooling fluid supply chamber through at least one first metering hole in the outer wall extending between the at least one outer wall diffusion chamber and the at least one central cooling fluid supply chamber;

at least one interlayer diffusion chamber positioned in the interlayer; and wherein the floating wall includes at least one second metering hole extending between the at least one outer wall diffusion chamber and the interlayer.

17. The turbine airfoil of claim 16, wherein the at least one interlayer diffusion chamber comprises a plurality of interlayer diffusion chambers that are coupled to a single outer wall diffusion chamber via the second metering holes; wherein the at least one outer wall diffusion chamber positioned in the outer wall of the generally elongated airfoil comprises a plurality of outer wall diffusion chambers.

18. The turbine airfoil of claim 17, wherein the plurality of outer wall diffusion chambers are positioned in rows extending generally in a chordwise direction such that the rows of outer wall diffusion chambers are positioned in a repeating pattern in which outer wall diffusion chambers in a row of outer wall diffusion chambers are offset in a chordwise direction from an adjacent row of outer wall diffusion chambers.

19. The turbine airfoil of claim 17, wherein the at least one outer wall diffusion chamber is positioned in the outer wall on the pressure and suction sides of the elongated hollow airfoil.

20. The turbine airfoil of claim 17, wherein the interlayer is formed from a material selected from the group consisting of a metallic felt metal pad and a porous fiber metal pad.

* * * * *